US009821372B2

(12) United States Patent
Gries

(10) Patent No.: US 9,821,372 B2
(45) Date of Patent: Nov. 21, 2017

(54) FENI BINDER HAVING UNIVERSAL USABILITY

(75) Inventor: Benno Gries, Wolfenbuettel (DE)

(73) Assignee: H. C. STARCK GMBH, Goslar (DE)

( * ) Notice: Subject to any disclaimer, the term of this patent is extended or adjusted under 35 U.S.C. 154(b) by 233 days.

(21) Appl. No.: 14/122,246

(22) PCT Filed: May 24, 2012

(86) PCT No.: PCT/EP2012/059748
§ 371 (c)(1),
(2), (4) Date: Nov. 26, 2013

(87) PCT Pub. No.: WO2012/163804
PCT Pub. Date: Dec. 6, 2012

(65) Prior Publication Data

US 2014/0086782 A1 Mar. 27, 2014

(30) Foreign Application Priority Data

May 27, 2011 (EP) ..... 11167901

(51) Int. Cl.

| | |
|---|---|
| ***C22C 29/00*** | (2006.01) |
| ***C22C 29/06*** | (2006.01) |
| ***C22C 38/08*** | (2006.01) |
| ***C22C 19/00*** | (2006.01) |
| ***B22F 1/00*** | (2006.01) |

(52) U.S. Cl.
CPC ..... *B22F 1/007* (2013.01); *C22C 19/00* (2013.01); *C22C 29/00* (2013.01); *C22C 29/005* (2013.01); *C22C 29/06* (2013.01); *C22C 29/067* (2013.01); *C22C 38/08* (2013.01)

(58) Field of Classification Search
CPC ..... B22F 1/007; C22C 29/00; C22C 29/005; C22C 29/06; C22C 29/067; C22C 38/08; C22C 38/105; C22C 19/00
See application file for complete search history.

(56) References Cited

U.S. PATENT DOCUMENTS 3,713,788 A 1/1973 Prill et al.
5,441,693 A 8/1995 Ederyd et al.
(Continued)

FOREIGN PATENT DOCUMENTS

CN 1960803 A 5/2007
DE 1 938 074 B1 12/1970
(Continued)

OTHER PUBLICATIONS

Sofue et al., JP 08-158002, published Jun. 1996. Machine translation.*
(Continued)

*Primary Examiner* — Keith Walker
*Assistant Examiner* — John Hevey
(74) *Attorney, Agent, or Firm* — Norman B. Thot

(57) ABSTRACT

A method for producing a composite material includes providing a composition comprising at least one hardness carrier and a base binder alloy, and sintering the composition. The base binder alloy comprises from 66 to 93 wt.-% of nickel, from 7 to 34 wt.-% of iron, and from 0 to 9 wt.-% of cobalt, wherein the wt.-% proportions of the base binder alloy add up to 100 wt.-%.

12 Claims, 2 Drawing Sheets

(56) References Cited

U.S. PATENT DOCUMENTS

| | | | | |
|---|---|---|---|---|
| 6,124,040 | A * | 9/2000 | Kolaska | B22F 3/1007 428/469 |
| 6,170,917 | B1 | 1/2001 | Heinrich et al. | |
| 7,438,741 | B1 * | 10/2008 | Bangaru | C22C 29/067 75/240 |
| 2002/0112896 | A1 | 8/2002 | Kruse et al. | |
| 2005/0115742 | A1 | 6/2005 | Daub et al. | |
| 2005/0117984 | A1 * | 6/2005 | Eason | B22F 3/15 408/144 |
| 2005/0211615 | A1 | 9/2005 | DiLeo et al. | |
| 2008/0029310 | A1 * | 2/2008 | Stevens | C22C 29/00 175/374 |
| 2010/0077887 | A1 | 4/2010 | Schrumpf et al. | |
| 2011/0286877 | A1 * | 11/2011 | Gries | C22C 1/0433 419/18 |

FOREIGN PATENT DOCUMENTS

| | | | | |
|---|---|---|---|---|
| DE | 10 2007 004 937 | A1 | 7/2008 | |
| EP | 1 488 020 | B1 | 12/2004 | |
| GB | 1 330 218 | A | 9/1973 | |
| JP | 49-90612 | A | 8/1974 | |
| JP | 53-88608 | A | 8/1978 | |
| JP | 53-108006 | A | 9/1978 | |
| JP | 60-39145 | A | 2/1985 | |
| JP | 61-261452 | A | 11/1986 | |
| JP | 63-45345 | A | 2/1988 | |
| JP | 63-81053 | A | 4/1988 | |
| JP | 07-150285 | * | 6/1995 | C22C 27/04 |
| JP | 08-0158002 | * | 6/1996 | C22C 32/00 |
| JP | 2004-516948 | A | 6/2004 | |
| RU | 2 096 513 | C1 | 11/1997 | |
| RU | 2009 115 953 | A | 11/2010 | |
| WO | WO 99/10551 | A1 | 3/1999 | |
| WO | WO 02/052054 | A1 | 7/2002 | |
| WO | WO 2005/077528 | A1 | 8/2005 | |
| WO | WO 2010/046224 | A2 | 4/2010 | |

OTHER PUBLICATIONS

Kawamura, JP 07-150285, published Jun. 1995. (Machine translation).*

International Standard ISO 3878, "Hardmetals—Vickers hardness test", pp. 1-4 (1983).

L. J. Prakash et al.: "WC Hardmetals with Iron Based Binders", 17th Plansee Seminar, vol. 2, pp. HM5/1-HM5/14 (2009).

B. Gries et al.: "Cobalt Free Binder Alloys for Hard Metals: Consolidation of Ready-To-Press Powder and Sintered Properties", Proceedings of the 2008 International Conference on Tungsten, refractory & Ilardmaterials VII, pp. 3-56-3-64 (2008).

B. Gries: "Selection Criteria of Fe Containing Hardmetal Binders for Metal Cutting Tools", Euro PM2009—Hard Materials III, pp. 1-6 (2009).

ASTM International B 330-07: "Standard Test Method for Fisher Number of Metal Powders and Related Compounds", pp. 1-6 (2007).

DIN EN ISO 6507-2: "Metallic materials—Vickers hardness test—Part 2: Verification and calibration of testing machines", pp. 1-25 (2006).

* cited by examiner

FENI BINDER HAVING UNIVERSAL USABILITY

CROSS REFERENCE TO PRIOR APPLICATIONS

This application is a U.S. National Phase application under 35 U.S.C. §371 of International Application No. PCT/EP2012/059748, filed on May 24, 2012 and which claims benefit to European Patent Application No. 11167901.5, filed on May 27, 2011. The International Application was published in German on Dec. 6, 2012 as WO 2012/163804 A1 under PCT Article 21(2).

FIELD

The present invention relates to a process for producing a composite material (composite) which is obtainable by sintering a composition containing a hardness carrier and a base binder alloy based on FeCoNi or FeNi. The present invention also relates to a sintered composite material which can be obtained by the process and its use for tools or parts, such as forming tools, comminution tools or machining tools (cutting machining tools).

Hard metal (cemented carbide; cemented hard material) is a sintered composite material composed of hardness carriers such as carbides and a binder alloy. Hard metals have a very wide variety of uses and are used, for example, for machining virtually all known materials. Hard metals can also be used, for example, as a structural component, as a forming tool or a comminution tool or for a wide variety of other purposes where wear resistance, mechanical strength or high temperature resistance are particularly important. A frequent field of application is the machining of metallic materials. Here, temperatures exceeding 800° C. occur locally as a result of cutting, forming and frictional processes. In other cases, forming of metallic workpieces is carried out at high temperatures, for example, in forging, wire drawing or rolling. The tool is here subject to mechanical stress which can lead to deformation of the hard metal tool. High temperature creep resistance (in practice, hot hardness is usually determined as a substitute) is therefore an important property of the hard metal tool. The fracture toughness ($K_1C$) is also, however, an important parameter in all applications since the tool or part cannot otherwise withstand peak mechanical stresses and can break. Wear resistance, hot hardness, fracture toughness and strength associated therewith (the latter usually reported as transrupture strength) can be adjusted via the size of the carbide phase and its proportion in the hard metal composition.

The properties of the hard metals also depend greatly on the binder alloy used. Fracture toughness, corrosion and hot hardness are determined mainly by the nature and basis of the binder alloy. The present invention relates to novel hard metals having a FeNi- or a FeCoNi-based binder alloy, which in terms of hardness (Vickers hardness in accordance with ISO 3878), fracture toughness ($K_1C$, calculated by the formula of Shetty from the crack lengths and the size of the Vickers hardness indentation) and also hot hardness corresponds to the properties of the hitherto customary hard metals having a Co-based binder alloy.

For various reasons, cobalt is replaced as a base alloy by other base binder alloys in specific hard metals. The term "base binder alloy" also encompasses pure metals having unavoidable impurities, for example, obtainable as commercially available Ni and cobalt metal powders.

Ni metal powders are, for example, used as a base alloy for producing hard metals which are corrosion-resistant in acids, oxidation-resistant or nonmagnetizable. Liquid-phase sintering results in formation of a binder alloy based on Ni. This binder alloy contains elements such as W, Co, Cr, Mo or others which have been added, for example, as metal powders or as a carbide to the hard metal mix, and whose contents lead to the Ni-based alloy, formed from pure Ni by alloying during liquid-phase sintering. Compared to pure nickel, these elements lead to better corrosion resistance. Hard metals having Ni as base binder alloy cannot be universally employed because of their low hardness values compared to materials bound using Co-based alloys. Hard metals bound using Ni-based alloys furthermore have comparatively low hot hardness. They are therefore not employed in machining of metallic materials.

FeCoNi-based alloys are furthermore known as hard metal binders. However, these have the disadvantage of low $K_1C$ values which are proportional to the transrupture strength according to the Griffith equation up to binder contents of about 12% by weight. The $K_1C$ values of a hard metal composed of a hardness carrier based on tungsten carbide (average powder diameter: 0.6 μm) together with 7.5% of FeCoNi 40/20/40 are thus in the range from 8.2 to 9.5 MPa $m^{1/2}$, while a hard metal having the same proportion by volume of cobalt (corresponding to 8% by weight due to the higher density of cobalt compared to FeCoNi 40/20/40) achieves a $K_1C$ of 9.5 MPa $m^{1/2}$.

Hot hardness of hard metals having FeCoNi-based alloys as binder is usually lower at higher temperatures than those of hard metals bound using cobalt-based alloys.

FeNi-based alloys are also known as binders. US 2002/0112896 A1 describes FeNi alloys based on from 35 to 65% of Ni and from 65 to 35% of Fe. The room-temperature strength of the FeNi 50/50 base alloy described is, however, comparatively low; a hard metal containing 7.4% of FeNi 50/50 (proportion by volume of the binder corresponding to 8% by weight of cobalt due to the lower density of FeNi 50/50) thus has a $K_1C$ of only 8.5 MPa $m^{1/2}$.

FeNi-based alloys comprising from 10 to 50% of Ni and from 90 to 50% of Fe are furthermore described in the thesis of Wittmann (Technical University of Vienna). These have, for example, at 15% of Ni and 85% of Fe, very high $K_1C$ values (above those which can be achieved using cobalt as base binder alloy; see results obtained by Wittmann, evaluated and published in: L. Prakash and B. Gries, Proceedings 17th Plansee Seminar 2009, Vol. 2, HM 5/1). This also applies to a FeNi 75/25 (see above reference, designated there as "A2500"). The hot hardness of hard metals having Fe-rich FeNi-based binder alloys at above 400° C. is, however, significantly below those of materials bound using Co-based alloys; this is made clear by the example of a base alloy of FeNi 82/18 (Proceedings International Conference on Tungsten, Refractory and Hard Metals, Washington, 2008, designated there as "M1800").

An attempt to explain the dependence of the hot hardness of hard metals on the composition of the FeCoNi-based alloys used looks at the maximum solubility of tungsten in the binder metal alloy which can be established after sintering of the hard metal (B. Gries, Proceedings EUROPM 2009 Copenhagen, Oct. 10-12, 2009). According thereto, the maximum hot hardness of hard metals having a FeNi-based alloy would have to be that of a binder alloy composed of pure Ni since the maximum solubility of tungsten in the binder alloy, about 25% by weight, is here attained. In practice, however, hard metals having a FeNi 50/50 base alloy having a tungsten solubility in the binder alloy of not more than 19.4% are equivalent in terms of the hot hardness with those having a cobalt-based alloy (maximum of 20% of W in the binder alloy). Despite the still higher solubility of tungsten, hard metals having Ni-based alloys are inferior to both those mentioned above in terms of the hot hardness and are therefore not used for applications where high hot hardness is important, for example, in cutting machining of metals.

EP 1 488 020 B1 describes FeCoNi-based alloys containing from 10 to 75% of Co as the hard metal binder and having an fcc structure for specific machining tasks; these alloys are said to reduce the adhesion wear occurring in the cutting machining of specific steels. The hot hardnesses of such hard metals comprising austenitic FeCoNi-based alloys are significantly inferior to those of materials comprising cobalt-based alloys. It can furthermore be assumed that the strength values of hard metals comprising these austenitic binder alloys will additionally be lower than those of hard metals bound using a cobalt-based alloy.

WO 2010/046224 A2 describes the use of molybdenum-doped pulverulent metal powders having a FeCoNi, CoNi and Ni basis, alloyed with molybdenum. However, above 400° C., the hot hardness of a WC and 8% of Co with 82% of the maximum magnetic saturation is not quite attained (FIG. 2 of WO 2010/046224 A2). In addition, the $K_1C$ is very highly dependent on the carbon content of the hard metal (Example 4 of WO 2010/046224 A2), which, in industrial practice of sintering, tends to fluctuate. The reliable attainment of the required properties of hardness, $K_1C$ and hot hardness thus depends sensitively on controlling the carbon balance, which cannot always be ensured under industrial conditions.

In summary, it can be said that neither Ni-, FeNi- nor FeCoNi-based alloys as hard metal binders lead to universally and industrially usable hard metals which are comparable simultaneously in terms of the aspects $K_1C$, hardness and hot hardness to those bound by means of binder alloys based on cobalt. Due to health hazards posed by cobalt and also for reasons of conservation of resources, it would be desirable to replace cobalt as binder alloy basis as completely as possible by FeNi or FeNi with small proportions of cobalt, if possible, below 10%. Contents of iron in the binder alloy and in the base binder alloy lead, in particular, to a reduction in or avoidance of the generation of hyperoxide radicals as are formed in the case of contact corrosion of WC with cobalt in the presence of water and oxygen.

A statistically significant increased occurrence of pulmonary fibrosis associated with handling dusts of hard metal has also been observed in the hard metals industry. The disease is also referred to as "hard metal lung". In conventional production of hard metal via powder-metallurgical production processes, i.e., pressing and sintering of pulverulent hard metal formulations, respirable dusts are liberated as a consequence of the process. If grinding of the sintered or presintered state of the hard metal is employed, very fine, respirable dusts (grinding dusts) are likewise formed. Particularly in the case of predominantly cobalt-containing hard metals, acute inhalation toxicity can additionally occur in grinding of presintered hard metals or sintered hard metals.

SUMMARY

An aspect of the present invention is to improve occupational health by providing hard metals, i.e., sintered composite materials, which have reduced acute toxicity. A further aspect of the present invention is to provide a process for producing a composite material which leads to hard metals which, both in terms of hot hardness and of hardness and fracture toughness, are at least equivalent to composite materials having a cobalt-based alloy as is routine in the prior art.

In an embodiment, the present invention provides a method for producing a composite material which includes providing a composition comprising at least one hardness carrier and a base binder alloy, and sintering the composition. The base binder alloy comprises from 66 to 93 wt.-% of nickel, from 7 to 34 wt.-% of iron, and from 0 to 9 wt.-% of cobalt, wherein the wt.-% proportions of the base binder alloy add up to 100 wt.-%.

BRIEF DESCRIPTION OF THE DRAWINGS

The present invention is described in greater detail below on the basis of embodiments and of the drawings in which.

DETAILED DESCRIPTION

Figure 1:
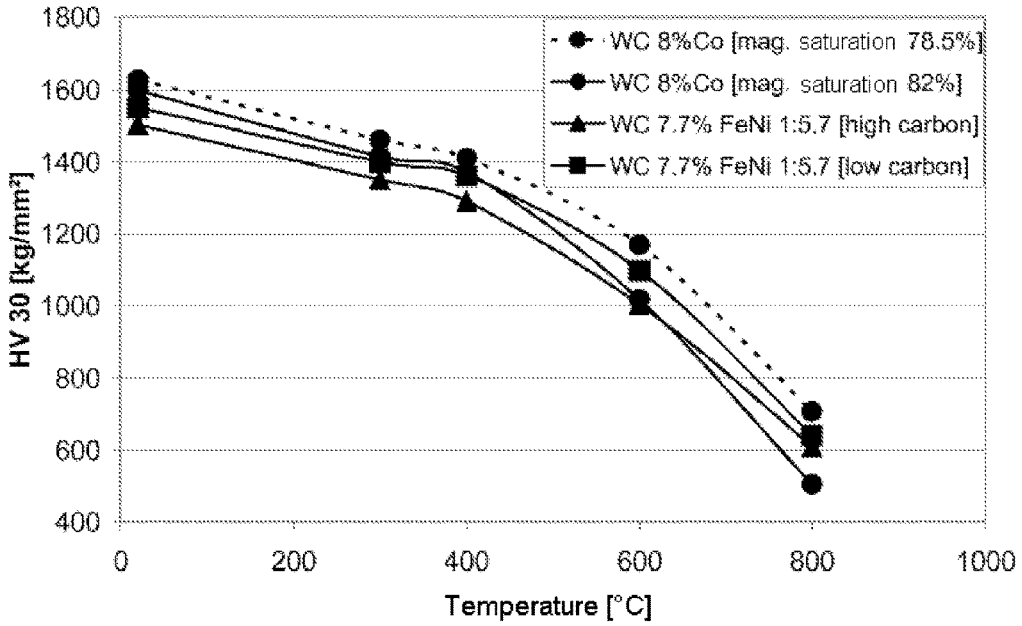
FIG. 1 shows the hot hardness (HV30) curves of Example 1 and Example 2.

It has now unexpectedly been found that particular hard metals having Ni-rich FeNi-based binder alloys are comparable in terms of hardness, hot hardness and fracture toughness ($K_1C$) with hard metals bound using cobalt-based binder alloys. This is completely unexpected since these results cannot be interpolated linearly from the behavior of pure nickel as a base and the behavior of FeNi 50/50. This is possibly the reason why no hard metals bound in this way have hitherto become known.

It has now surprisingly been found that the problems arising from the prior art can be solved by the composite materials produced according to the present invention.

The present invention provides a process for producing a composite material, which comprises sintering a composition containing:

a) at least one hardness carrier, and b) a base binder alloy comprising:

α) from 66 to 93% by weight of nickel,

β) from 7 to 34% by weight of iron, and

γ) from 0 to 9% by weight of cobalt, where the proportions by weight of the base binder alloy add up to 100% by weight.

For the purposes of the present invention, the terms "hard metal" (or "cemented carbide" or "cemented hard material") and "sintered composite material" (or "sintered composite") are used synonymously.

In an embodiment of the present invention, the base binder alloy can, for example, have a weight ratio of iron:nickel of from 1:2 to 1:13, for example, from 1:2.5 to 1:12, for example, from 1:3 to 1:10, for example, from 1:3 to 1:9, for example, from 1:4 to 1:8, and for example, from 1:4 to 1:7.

Good results can be obtained using base binder alloys having from 66 to 90% by weight, for example, from 70 to 90% by weight, of nickel.

Base binder alloys having from 10 to 34% by weight of iron can, for example, be used. An iron content in the base binder alloy of from 10 to 30% by weight can, for example, be used.

Due to the toxic properties of cobalt, the content of cobalt in the base binder alloy should be kept as low as possible. The base binder alloy can therefore contain less than 8% by weight, for example, less than 5% by weight, and for example, less than 1% by weight, of cobalt. In an embodiment, the base binder alloy can, for example, be essentially free of other elements, for example, essentially free of metals other than nickel and iron. Nonmetals such as carbon, oxygen and nitrogen can be present in the base binder alloys and are acceptable since their contents in the sintered composite material can be desirable and can completely or partly volatilize during sintering.

For the purposes of the present invention, "essentially free" means that the element is present in an amount of less than 0.5% by weight, for example, less than 0.1% by weight, for example, less than 0.08% by weight, for example, less than 0.02% by weight, for example, less than 0.001% by weight, and for example, less than 0.005% by weight, in each case based on the total weight of the base binder alloy.

In an embodiment of the process of the present invention, the base binder alloy can, for example, contain less than 0.1% by weight, for example, less than 0.08% by weight, for example, less than 0.02% by weight, and for example, less than 0.01% by weight, of molybdenum.

A further constituent of the composition is the hardness carrier. In an embodiment of the present invention, the hardness carrier can, for example, be selected from the group consisting of carbides, nitrides, borides and carbonitrides. These can, for example, contain one or more elements of transition group 4A, 5A or 6A of the Periodic Table of Elements. The hardness carriers can be binary hardness carriers, for example, tungsten carbide, as well as ternary hardness carriers, for example, tantalum-niobium mixed carbide, titanium carbonitride or tungsten-titanium carbide, or even quaternary hardness carriers, for example, tungsten-titanium carbonitride, or tungsten-titanium-niobium-tantalum carbide.

In an embodiment of the present invention, the hardness carrier can, for example, be selected from the group consisting of titanium carbide, chromium carbide, tantalum carbide, niobium carbide, vanadium carbide, molybdenum carbide, tantalum-niobium mixed carbide, titanium carbonitride, tungsten-titanium carbide, tungsten-titanium carbonitride and tungsten carbide.

In an embodiment of the present invention, the hardness carrier can, for example, comprise at least 50% by weight of tungsten carbide, based on the total weight of the hardness carriers. In an embodiment, the hardness carrier can, for example, comprise at least 50% by weight of titanium carbonitride, based on the total weight of the hardness carriers.

The hardness carriers can, for example, be provided in pulverulent form. In an embodiment, the powders can have an average particle diameter of from 0.01 to 150 μm, for example, from 0.1 to 100 μm.

The average particle diameter is determined in accordance with ASTM B330.

The hardness carriers can, for example, have a hardness above 800 kg/mm$^2$, for example, above 1000 kg/mm$^2$ (measured in accordance with ISO 6507, part 2).

The composition used in the process of the present invention can, for example, contain various pulverulent components. The base binder alloy based on FeNi or FeCoNi can be provided by means of prealloyed powders or powders obtained from the melt but also by means of metal powders, i.e., for example, by means of iron, nickel and optionally cobalt powders.

In an embodiment of the present invention, the hardness carrier and/or the base binder alloy can, for example, be in pulverulent form. In an embodiment, the base binder alloy can, for example, be present as an alloy powder.

The compositions used in the process of the present invention can optionally also comprise further components as additives, such as metals, for example, selected from the group consisting of rhenium, molybdenum, chromium and aluminum. Elemental tungsten or elemental carbon can, for example, be used since these are suitable for correcting the carbon content of the composite material after sintering. It is also possible, however, to add intermetallic compounds such as $Ni_3Al$ or chromium nitride which decomposes during sintering to the compositions to be sintered. These additives can make up to 20% by weight, for example, up to 10% by weight, of the total weight of the composition.

In an embodiment of the present invention, the composition to be used in the process of the present invention can, for example, comprise from 50% by weight to 97% by weight of hardness carriers, for example, from 60% by weight to 96% by weight, for example, from 70% by weight to 96% by weight, of hardness carriers, in each case based on the total weight of the composition.

In an embodiment of the present invention, the composition can, for example, contain from 3 to 50% by weight of the base binder alloy, for example, from 4 to 40% by weight, for example, from 4 to 30% by weight, of the base binder alloy, in each case based on the total weight of the composition.

The total weight of base binder alloy, hardness carriers and additives which may optionally be present is 100% by weight.

Sintering can, for example, be carried out at temperatures above 1000° C., for example, above 1100° C., for example, at temperatures in the range from 1150° C. to 1600° C. Sintering can, for example, be carried out in the presence of a liquid phase. The base binder alloy can, for example, be entirely or partly present in a liquid form during the sintering process.

Sintering time can vary as a function of composition. Sintering is usually carried out over a period of at least 5 minutes, for example, at least 10 minutes. Sintering time and sintering temperature are related since the time necessary for full densification can be shortened at higher sintering temperatures. The necessary sintering time and, in particular, temperature, also depends greatly on the content of base binder alloy. While, for example, the sintering temperature could be reduced down to 1250° C. at a content of the base binder alloy of 20% by weight, temperatures above 1400° C. are desirable at 5% by weight of base binder alloy. The sintering times which can be realized depend on the heat capacity of the sintering furnaces since these cannot be heated up to the sintering temperature and cooled down at any desired rate. Very short sintering times of a few minutes can, however, be realized by means of microwave sintering or SPS.

In an embodiment of the present invention, the process of the present invention comprises the following steps:

a) provision of a dispersion comprising a composition containing hardness carriers and base binder alloy, as defined above, in a solvent,
b) milling of the dispersion,
c) production of a powder by drying of the dispersion,
d) production of compacts by pressing the powder or by extrusion of the powder with the aid of plasticizing agents, and
e) sintering of the compact or of the extrudate.

In an embodiment of the present invention, the provision of the dispersion described in step a) can, for example, be carried out by adding a solvent to a pulverulent composition containing hardness carriers and base binder alloy powder. Examples of solvents include those which have a boiling point of <250° C. at 1 bar. Examples include alcohols, for example, aliphatic alcohols, for example, ethanol, and to water or mixtures thereof, for example, mixtures of water and organic solvents, such as water and alcohols. Examples also include organic solvents, for example, selected from the group consisting of ketones and hydrocarbons, for example, acetone and aliphatic hydrocarbons such as heptane and hexane.

Milling of the dispersion produced in step a) can be carried out using the milling tools with which a person skilled in the art will be familiar. Milling of the dispersion can, for example, be carried out in a ball mill or an attritor which can, for example, in each case be equipped with hard metal balls.

The dispersion can optionally also contain organic auxiliaries such as waxes, dispersants, inhibitors, adhesives or emulsifiers before the drying step.

In an embodiment of the present invention, step b) can, for example, be followed by production of a powder by drying of the dispersion. The dispersion can, for example, be spray dried or dried under reduced pressure. It has been found to be advantageous here to use solvents with a low boiling temperature which can easily be distilled off under reduced pressure as a solvent.

In an embodiment of the present invention, the dried powder from step c) can, for example, be used to produce compacts (pressed bodies) or an extrudate. Pressing of the dried powder can, for example, be carried out in tools suitable for this purpose, or isostatically.

The compact or the extrudate is subsequently sintered in step e). In an embodiment of the present invention, sintering can, for example, be carried out in the presence of a protective gas atmosphere or under reduced pressure.

In an embodiment of the present invention, the sintered composite materials can, for example, be compacted further in a separate or integrated post-compaction step under increased pressure.

In an embodiment of the present invention, pressing and sintering can, for example, be carried out simultaneously and, for example, by additional use of electric fields or currents. These can provide an elevated temperature during sintering and pressing.

The composite materials obtained by the process of the present invention are optionally subsequently ground to the required shape, with tools for cutting machining of metals usually being able to be coated further by means of chemical vapor deposition (CVD) techniques or physical vapor deposition (PVD) or combined processes.

The present invention further provides a sintered composite material obtainable by the process of the present invention.

The composite materials of the present invention comprise one or more elements from the group consisting of Fe, Ni and optionally Co as a binder alloy. Apart from this basis, the binder alloy contains elements whose content in the binder alloy cannot, in contrast to those mentioned above, be selected freely but are instead the result of solubilities and establishment of equilibria during sintering. These are, in particular, W, Mo and Cr and in smaller amounts also other carbide-forming metals (for example V, Ti, Zr, Hf, Ta, Nb) and in particular carbon, but also metals which do not form carbides, e.g. rhenium and ruthenium. The binder alloy present in the sintered hard metal is thus formed only during sintering from the base alloy and the establishment of equilibria with the other components still present in the hard metal. Such elements can also be previously present in the base alloy. However, the ultimate composition of the binder alloy is only established during sintering and subsequent cooling of the hard metal.

The binder alloy can furthermore also contain one or more elements selected from the group consisting of W, Mo, Cr, V, Ta, Nb, Ti, Zr, Hf, Re, Ru, Al, Mn, C. These elements have only a limited solubility both in the FeNi base alloy and in other base alloys and the contents thereof are established during sintering and during cooling as a result of their temperature-dependent solubility with additional dependence on the carbon content according to the principle of the solubility product of the carbides as a function of their thermodynamic stability. The sum of these elements in the binder alloy according to the present invention is therefore generally below 30% by weight, based on the total weight of the binder alloy of the sintered composite material.

In an embodiment of the present invention, the binder alloy of the sintered composite material of the present invention can, for example, comprise up to 30% by weight of one or more elements selected from the group consisting of W, Mo, Cr, V, Ta, Nb, Ti, Zr, Hf, Re, Ru, Al, Mn, B, N and C.

Selection and contents of the above elements have an influence on the properties of the binder alloy. Thus, for example, W, Cr and Mo increase the hot hardness because of their solubilities on the order of at maximum from 5 to 25% by weight. Efforts are therefore made in industrial practice to set the carbon content of the hard metal low so that the contents of these elements are as high as possible in the binder alloy without detrimental carbon-depleted phases (known as eta phases) occurring. The actual dissolved tungsten content in hard metals containing Co-based alloys is determined via magnetic saturation. If the magnetic saturation of the Co content of pure WCCo hard metals is less than 70% of that of pure cobalt, eta phases are formed. However, in industry, a safe distance from this limit is maintained for reasons of process reliability.

The sintered composite materials (hard metals) of the present invention can be ground and coated depending on the requirements of the envisaged use. They can also be inserted into tool holders, adjoined, soldered or diffusion-welded.

The hard metals of the present invention can be used for all applications where hard metals having a binder alloy based on cobalt, nickel, CoNi, FeNi or FeCoNi are used at present.

The hard metal part present after sintering and optionally after grinding or final electroeroding can advantageously have a defined geometry. This can, for example, be elongated (for example, ground out from a round sintered rod), but can also be plate-shaped for turning or milling materials such as metals, stones and composites. In all cases, the hard metal tools can, for example, have one or more coatings selected from the classes of nitrides, borides, oxides and superhard layers (for example, diamond, cubic boron nitride). These can have been applied by PVD or CVD processes or combinations or variations thereof and have their residual stress state altered after application. However, they can, for example, also be hard metal parts of any further geometry and for any further use, such as forging tools, forming tools, core drills, construction parts, knifes, peeling plates, rolls, stamping tools, pentagonal drill bits for soldering-in, mining chisels, milling tools for machining of concrete and asphalt, sliding ring seals and also any further geometries and uses.

For some applications, the hard metal can also have the surface formed during sintering, and optionally subsequently be used in coated or uncoated form.

The present invention further provides for the use of the sintered composite material of the present invention for tools or parts. The sintered composite materials of the present invention can, for example, be used for forming or comminution tools. In an embodiment of the present invention, the tool can, for example, be a tool for cutting machining of metallic tools or for forming of metal workpieces at high temperatures, for example, a tool for forging, wire drawing or rolling.

The present invention further provides for the use of a base alloy comprising:

α) from 66 to 93% by weight of nickel,

β) from 7 to 34% by weight of iron, and

γ) from 0 to 9% by weight of cobalt, for producing a composite or a tool.

The present invention will hereinafter be illustrated by the following examples without being restricted thereto.

EXAMPLES

Example 1 (Comparative)

460 g of tungsten carbide having a particle size of 0.6 μm in accordance with ASTM B330 (type WC DS60, manufacturer: H.C. Starck GmbH, Goslar, Germany) were mixed-milled with 40 g of a commercial cobalt powder (type "efp"; manufacturer: Umicore, Belgium) in 0.57 liter of 94% ethanol at 63 rpm in a ball mill for 14 hours. 5 kg of hard metal balls were used. Two batches having different carbon contents ("high carbon" and "low carbon") were produced so that different carbon contents and thus different magnetic saturations of the hard metals respective the cobalt-based binder alloys present were obtained after sintering.

The ethanol was separated off from the resulting suspension by distillation under reduced pressure and the hard metal powder obtained was uniaxially pressed at 150 MPa and sintered at 1420° C. The plate-shaped hard metal pieces were ground, polished and examined to determine their properties. As sintered bodies, both batches displayed neither eta phases nor carbon precipitates. The different carbon content after sintering and the associated different tungsten content in the binder metal alloy is the result of mass transfer during sintering. The binder metal alloy thus consists of cobalt as basis with proportions of tungsten and possibly carbon.

TABLE 1

| | Carbon | |
|---|---|---|
| | "low carbon" | "high carbon" |
| Hardness (HV 30) (kg/mm$^2$) | 1626 | 1597 |
| Magnetic saturation (G · cm$^3$/g) | 123 | 132 |
| Porosity (ISO 4505) | <A02B00C00 | <A02<B02C00 |
| Fracture toughness (MPa · m$^{1/2}$) | 9.3 | 9.5 |
| Density (g/cm$^3$) | 14.78 | 14.74 |

In both cases, room temperature hardness was determined as Vickers hardness HV30 in accordance with ISO 3878 as well as hot hardness was determined at selected temperatures up to 800° C. under protective gas in a hardness testing apparatus (FIG. 1). For this purpose, both hard metal batches were sintered again and the pieces obtained had a density of 14.79 g/cm$^3$ and a magnetic saturation of 127 (+/−1) Gcm$^3$/g, corresponding to 78.5% of the theoretically possible magnetic saturation in the case of the "low carbon" variant. The "high carbon" variant had, on average, a density of 14.75 (+/−0.01) g/cm$^3$ and a magnetic saturation of 133 (+/−1) Gcm$^3$/g, corresponding to 82% of the theoretical saturation.

Fracture toughness $K_1C$ was determined according to the formula of Shetty:

$$K_1C=0.0028\times 9.81\times(HV30/R)^{1/2} \text{ (in MPa m}^{1/2}\text{)}.$$

R=crack resistance=30/sum of the length of the cracks (in μm)×1000.

HV30=Vickers hardness under a load of 30 kg (kg/mm$^2$).

Example 2 (Inventive)

Example 1 was repeated, but in this case the two batches consisted of 461.5 g of tungsten carbide having a particle size of 0.6 μm and the binder metal basis consisted of 38.5 g of an alloy powder containing 15% by weight of Fe and 85% by weight of Ni. The carbon content of these hard metal batches was set by addition of carbon black (5.55% for the "low carbon" variant and 5.65% for the "high carbon" variant) so that neither eta phases nor carbon precipitates were obtained after sintering at 1440° C. for 60 minutes. The different carbon content after sintering and the associated different tungsten content in the binder metal alloy is the result of mass transfer during sintering. The binder metal alloy thus consists of iron and nickel in a weight ratio of 1:5.7 as basis, alloyed with proportions of tungsten and possibly carbon.

The results after sintering at 1420° C. for 60 minutes and metallographic examination are shown in Table 2 below:

TABLE 2

| | Carbon | |
|---|---|---|
| | "low carbon" | "high carbon" |
| Hardness (HV30) | 1574 | 1591 |
| Magnetic saturation (G · cm$^3$/g) | 51 | 66.8 |
| Porosity (ISO 4505) | <A02B00C00 | <A02B00C00 |
| Fracture toughness (MPa · m$^{1/2}$) | 10.2 | 11 |
| Density (g/cm$^3$) | 14.83 | 14.81 |

The room temperature hardness values are somewhat lower than those from Example 1, which is due to the low hardness and higher plasticity of the austenitic base alloy. However, the fracture toughnesses are, even taking account of the somewhat lower hardnesses, at least on the same level as in Example 1. Increasing carbon values in the sintered body correlate with increasing magnetic saturation and, owing to the low density of graphite, with decreasing density.

The hot hardnesses were determined as before (for results, see FIG. 1). For this purpose, fresh sintered bodies were produced from the hard metal batches available. The "low carbon" variant had here achieved a density of 14.81 g/cm$^3$ and a magnetic saturation of from 54 to 55 Gcm$^3$/g. The "high carbon" variant gave densities in the range from 14.77 to 14.79 g/m$^3$ and magnetic saturations in the range from 70.5 to 72.5 Gcm$^3$/g. The boundary to the eta phase is below 51 Gcm$^3$/g, and the boundary to carbon precipitation is about 75 Gcm$^3$/g. The sintered pieces were thus free of eta phase and carbon precipitates. The two sintered batches were thus in the middle and high range, but not in the low range, for the carbon content, which would have been advantageous for a high hot hardness.

FIG. 1 shows the hot hardness curves and demonstrates that the hard metals according to the present invention with the base binder alloy based on FeNi are in the range of the hot hardness of hard metals bound using a cobalt basis despite the medium and high carbon content, have the same proportion by volume of base binder alloy and are in the lower half of the carbon window and thus have good hot hardnesses. The results obtained in this way for the hot hardness are thus determined by the nature of the base binder alloy. It should be emphasized that this effect occurs even though the starting level of the hardness is lower compared to Example 1.

It can also be seen that in the case of this base binder alloy, the properties $K_1C$ and hot hardness are advantageously only slightly dependent on the carbon content of the hard metal.

The room temperature hardness values in the hot hardness curve are not identical with those from the above tables of Examples 1 and 2 since they were determined by means of a different hardnesses testing apparatus, namely the hot hardness tester.

Example 3 (Comparative)

In a manner analogous to Example 2, various batches were produced from a WC (0.6 μm particle size and 7.5% of a FeCoNi alloy powder (Ampersint® MAP A6050, manufacturer: H.C. Starck GmbH, Germany, composition: Fe 40%, Co 20%, Ni 40%) as binder metal basis. The proportion by volume of the base binder alloy corresponds to that of Example 1.

The hard metals obtained, which contained neither eta phase nor carbon precipitates, had an HV30 in the range from 1626 to 1648. The $K_1C$ values were mostly in the range from 8.5 to 8.9 MPa $m^{1/2}$. Only in a very narrow range at high carbon contents at the boundary to the region of carbon precipitation were values of from 9.3 to 9.5 found for the $K_1C$.

The inferiority of the FeCoNi-based alloy in terms of the hot hardness has already been publicized in WO 2010/046224 (there, Example 1 and FIG. 1).

In summary, hard metals having a FeCoNi 40/20/40 base binder are inferior in terms of $K_1C$ and hot hardness to hard metals bound by means of cobalt as basis for the binder alloy.

Example 4 (Comparative)

Figure 2:
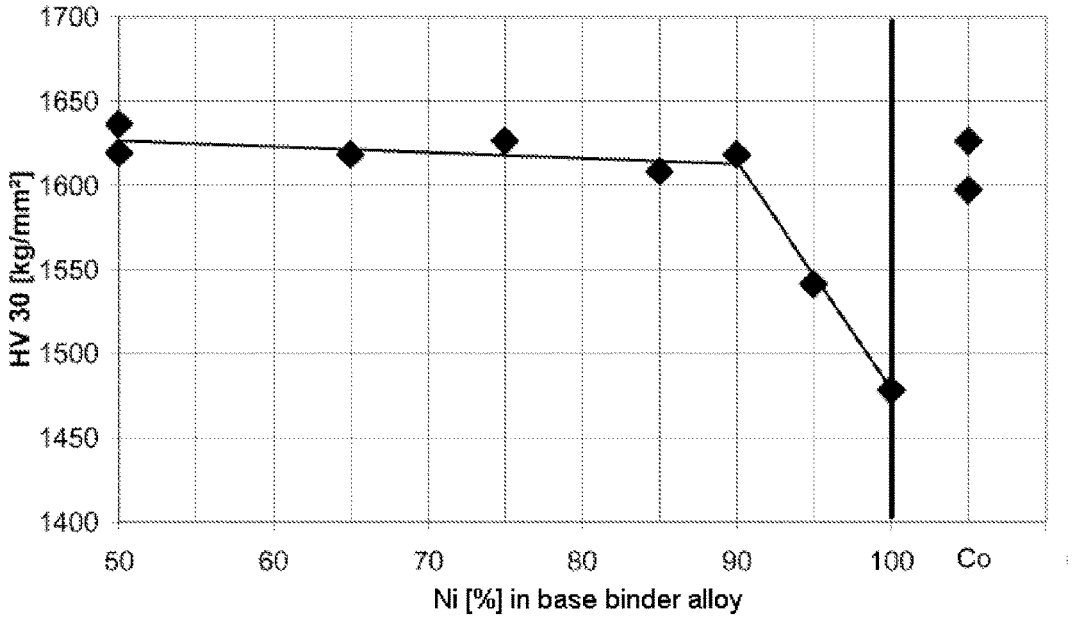
FIG. 2 shows the hot hardness (HV30) values of Example 5 and a comparison of the hot hardness (HV30) values of Example 1 and Example 4.

In a manner analogous to Example 1, hard metals were produced using 7.4% by weight of a FeNi 50/50 alloy powder (Ampersint® MAP A5000, manufacturer: H.C. Starck GmbH, Germany) as base binder alloy. The proportion by volume of the base binder alloy corresponds to that in Example 1. The hard metals obtained, which were free of eta phases or carbon precipitates, had HV30 values in the range from 1619 to 1636. The $K_1C$ values were in the range from 8.3 to 8.6 MPa $m^{1/2}$. FIG. 2 shows that the hot hardness values correspond to those of a corresponding hard metal with cobalt as base binder alloy.

Figure 3:
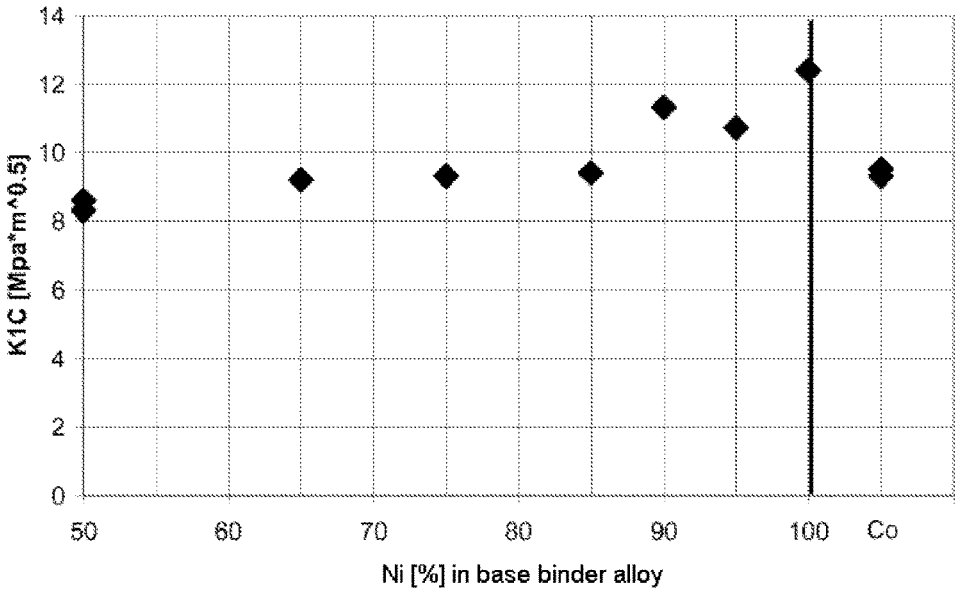
FIG. 3 shows the fracture toughness ($K_1C$) values of Example 5 and a comparison of the fracture toughness ($K_1C$) values of Example 1 and Example 4.

Hard metals with a binder alloy based on FeNi 50/50 thus have at least equal hot hardnesses but display comparatively low $K_1C$ values, so that hard metals having such a binder basis cannot be universally used (FIG. 3). Although hard metals having this base binder alloy can thus be used for turning of metals, they cannot be used for milling because of their low $K_1C$ value since the mechanical shock resistance is insufficient.

Example 5 (Partly Inventive—as Indicated by "*")

In a manner analogous to Example 1, hard metals having different Fe/Ni ratios in the range from 35/65 to 0/100 were produced. In all cases, the proportion by volume of the base binder alloy corresponded to that in Example 1. The Fe:Ni ratio in the base binder alloy was varied by using FeNi 50/50 as in Example 4 (Fe:Ni ratio 1:1) and a Ni powder (manufacturer: Vale-Inco, GB, type 255) in such amounts that the desired Fe:Ni ratio was obtained and the proportion by volume of Example 1 was attained. Additional variation of the carbon content in the batches ensured that all hard metals were free of carbon precipitates and also of eta phases after sintering. All hard metals were sintered together at 1420° C. for 60 minutes.

Table 3 below summarizes the results obtained in this way:

TABLE 3

| Fe/Ni ratio | HV30 (kg/mm$^2$) | K1C (MPa m$^{1/2}$) | Density (g/cm$^3$) | Magnetic saturation (G cm$^3$/g) |
|---|---|---|---|---|
| 35/65* | 1618 | 9.2 | 14.75 | 102 |
| 25/75* | 1626 | 9.3 | 14.67 | 94.7 |
| 15/85* | 1608 | 9.4 | 14.74 | 98.4 |
| 10/90* | 1618 | 11.3 | 14.84 | 42.3 |
| 5/95 | 1541 | 10.7 | 14.79 | 38.2 |
| 0/100 | 1478 | 12.4 | 14.81 | 42.7 |

FIGS. 2 and 3 show the results of Example 5 and compare Examples 1 and 4.

It is evident that the hardness decreases only very slightly with increasing nickel contents, while the $K_1C$ increases slightly and at about 65% of Ni reaches the values of the comparative hard metals from Example 1. This also applies to the $K_1C$, for which values above 10 have a tendency to larger relative errors. The $K_1C$ values were calculated from the crack lengths according to the formula of Shetty. Since large relative errors occur when reading off the crack length under the microscope in the case of very short crack lengths but short crack lengths yield high $K_1C$ values, the relative error in the $K_1C$ increases steadily with the measured value itself, as can readily been seen in the figure.

Surprisingly, however, the hardness barely decreases from 50% of Ni to unexpectedly high Ni contents of 90%. The hardness surprisingly remains virtually constant up to values of 90% of Ni, and then decreases suddenly. It can be interpolated that the required hardness level given by the relatively low hardness value of comparative Example 1 is achieved at Ni contents from up to 93%.

The combination of properties of the WCCo hard metals from Example 1 are achieved at a Fe/Ni ratio in the range from about 34/66 (corresponding to about 1:2) to 7/93 (corresponding to about 1:13); below this, the $K_1C$ decreases and above this, the hardness decreases very greatly and sharply.

The present invention is not limited to embodiments described herein; reference should be had to the appended claims.

What is claimed is:

1. A method for producing a composite material, the method comprising:

providing a composition comprising:

a) from 92 to 97 wt.-% of at least one hardness carrier; and b) from 3 to 8 wt.-% of a base binder alloy consisting of:

from 80 to 93 wt.-% of nickel, from 7 to 20 wt.-% of iron, from 0 to 9 wt.-% of cobalt, and up to 13 wt.-% of one or more elements selected from the group consisting of W, Mo, V, Ta, Nb, Zr, Hf, Re, Ru, B, N and C, wherein the wt.-% proportions of the base binder alloy add up to 100 wt.-% and the wt.-% proportions of the at least one hardness carrier and the base binder alloy add up to 100 wt.-%;

and, sintering the composition, wherein, the at least one hardness carrier is selected from the group consisting of a carbide, a nitride, a boride, and a carbonitride, and the at least one hardness carrier comprises at least one element of the transition groups 4A, 5A and 6A of the Periodic Table of Elements.

2. The method as recited in claim 1, wherein a weight ratio of iron:nickel in the base binder alloy is from 1:4 to 1:7.

3. The method as recited in claim 1, wherein the base binder alloy comprises from 80 to 90 wt.-% of nickel.

4. The method as recited in claim 1, wherein the base binder alloy contains less than 8 wt.-% of cobalt.

5. The method as recited in claim 1, wherein the base binder alloy contains less than 0.1 wt.-% of molybdenum.

6. The method as recited in claim 1, wherein the at least one hardness carrier is selected from the group consisting of a carbide, a nitride, a boride, and a carbonitride.

7. The method as recited in claim 1, further comprising:

a) providing a dispersion comprising the composition in a solvent;

b) milling the dispersion so as to produce a milled dispersion;

c) drying the milled dispersion so as to produce a powder;

d) pressing the powder so as to produce a compact or extruding the powder with the aid of a plasticizing agent so as to produce an extrudate; and e) sintering the compact or the extrudate.

8. A sintered composite material obtainable by the method recited in claim 7.

9. A method of using the sintered composite material as recited in claim 8 for a tool or a part, the method comprising:

providing a tool or a part comprising the sintered composite material as recited in claim 8; and using the tool or the part in at least one of a forming step, a comminution step, a cutting step, a machining step, a forging step, a wire drawing step, and a rolling step.

10. The method of using as recited in claim 9, wherein the tool is a form tool or a comminution tool.

11. The method of using as recited in claim 9, wherein the tool is a tool configured to cut/machine a metallic tool or to form a metal workpiece at a high temperature.

12. The method of using as recited in claim 11, wherein the tool is configured to forge, to draw a wire, or to roll.

* * * * *